United States Patent [19]

Gladow et al.

[11] 4,114,869

[45] Sep. 19, 1978

[54] MECHANISM FOR EFFECTING INTERLOCK OF MULTIPLE SHEET CONTINUOUS BUSINESS FORMS

[75] Inventors: Dean E. Gladow; Kenneth C. Clifton, both of Emporia, Kans.

[73] Assignee: Didde-Glaser, Inc., Emporia, Kans.

[21] Appl. No.: 781,669

[22] Filed: Mar. 28, 1977

[51] Int. Cl.[2] ..... B41L 43/12

[52] U.S. Cl. ..... 270/37; 83/11; 270/53; 282/12 A

[58] Field of Search ..... 270/21, 37, 53; 83/6–12; 93/63 R, 63 M, 1 G, 1.1; 229/69 R; 282/11.5 A, 12 A, 12 B

[56] References Cited

U.S. PATENT DOCUMENTS

| | | | |
|---|---|---|---|
| 2,935,002 | 5/1960 | Robinson | 282/11.5 A |
| 3,107,929 | 10/1963 | Bohmert | 282/11.5 R |
| 3,727,908 | 4/1973 | Whitesell | 270/53 |

FOREIGN PATENT DOCUMENTS

| | | | |
|---|---|---|---|
| 1,049,223 | 11/1966 | United Kingdom | 270/53 |

*Primary Examiner*—Edgar S. Burr
*Assistant Examiner*—A. Heinz
*Attorney, Agent, or Firm*—Schmidt, Johnson, Hovey & Williams

[57] ABSTRACT

A highly efficient, shear-cutting, multiple die apparatus and method for interlocking elongated, multiple-sheet glued webs such as business forms or computer print out paper during fabrication thereof is provided which positively locks the web sheets against relative shifting as can occur when the web is zigzag folded, in order to prevent "tenting", or permanent, glue-set misalignment between respective web plies at the fold lines thereof. The preferred apparatus includes individual, mated pairs of rotatably mounted, transversely oriented, multiple-blade, pointed, web-shearing and deforming dies which are rotated to cooperatively engage, shear-penetrate and deform a moving web to produce a series of transversely extending, side-by-side, marginal, alternately displaced interlocking strips which effectively prevent significant relative longitudinal shifting between the web plies. The blade tips of the cooperating dies interfit during the web-shearing and displacing operation and serve to provide equal support and driving force for the web on opposite sides thereof, so that the web experiences minimum disturbance and no initiating causes for web skewing. The blade tips are contoured such that the opposed ends of the shear-cut strips remain connected to the web, to thus provide the most desirable positive web interlock, even at high or varying web speeds. In preferred forms, press-ironing rings are rotated with the interlocking dies for ironing the glued portion of the web in conjunction with formation of the interlocking strips.

21 Claims, 21 Drawing Figures

Fig. 1.
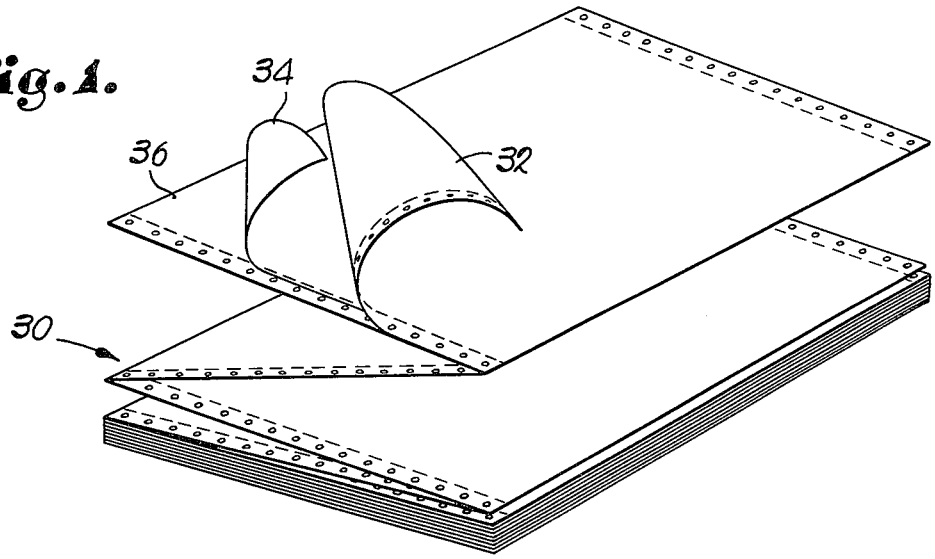
Fig. 2.
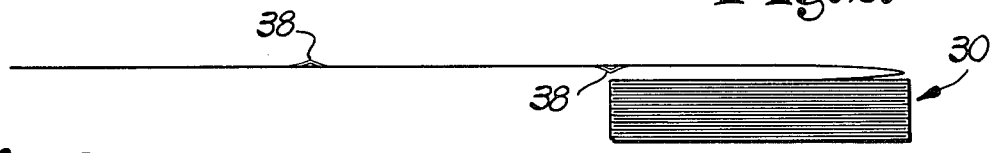
Fig. 3.
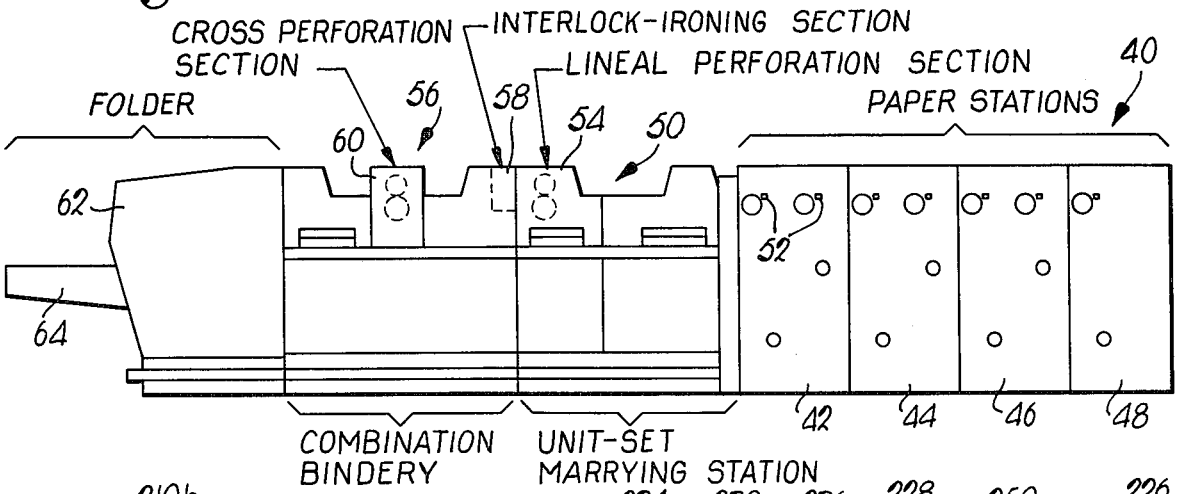
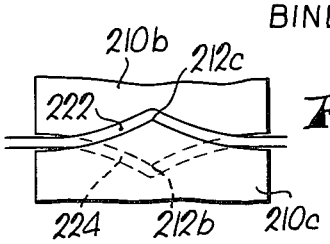
Fig. 13.
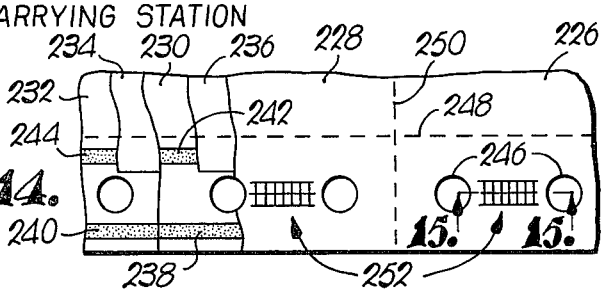
Fig. 14.
Fig. 16.
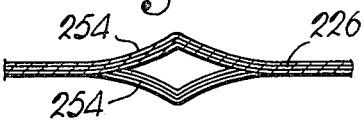
Fig. 15.
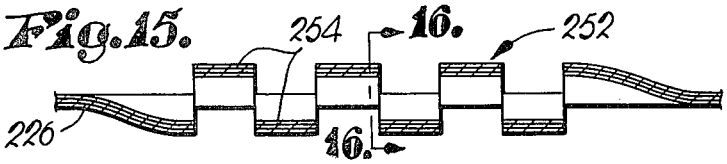

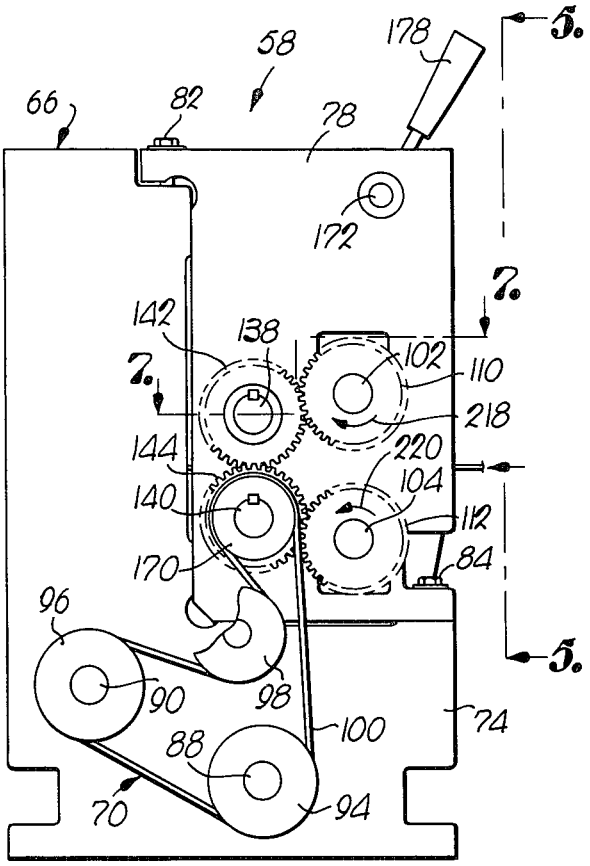
Fig. 4.
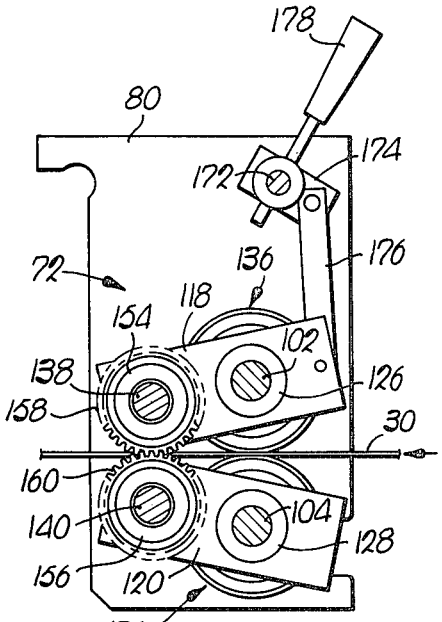
Fig. 6.
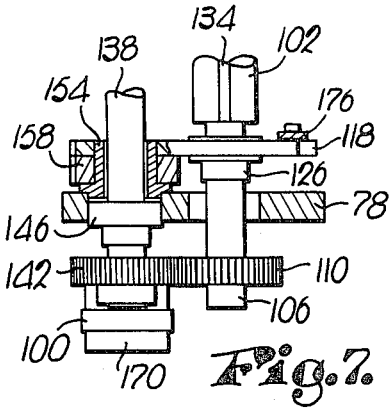
Fig. 7.
Fig. 5.
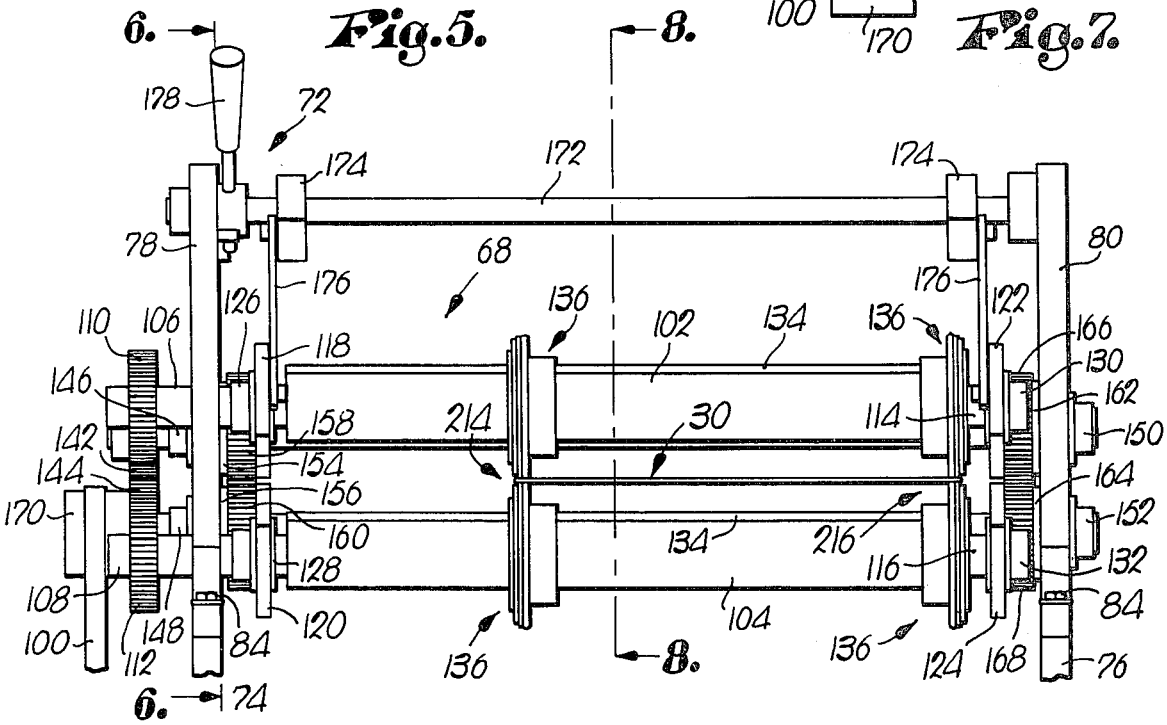

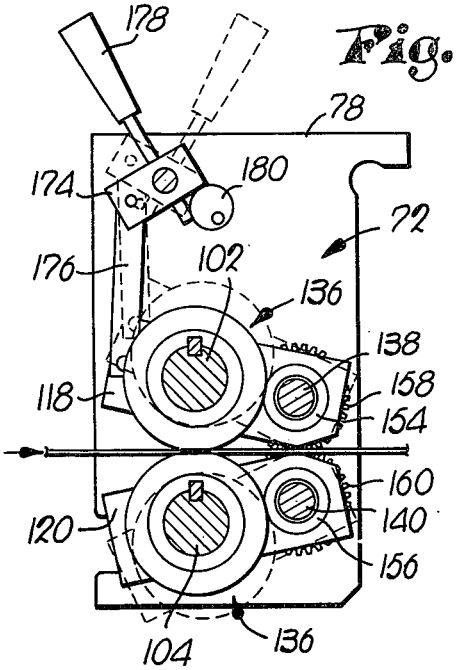
Fig.8.
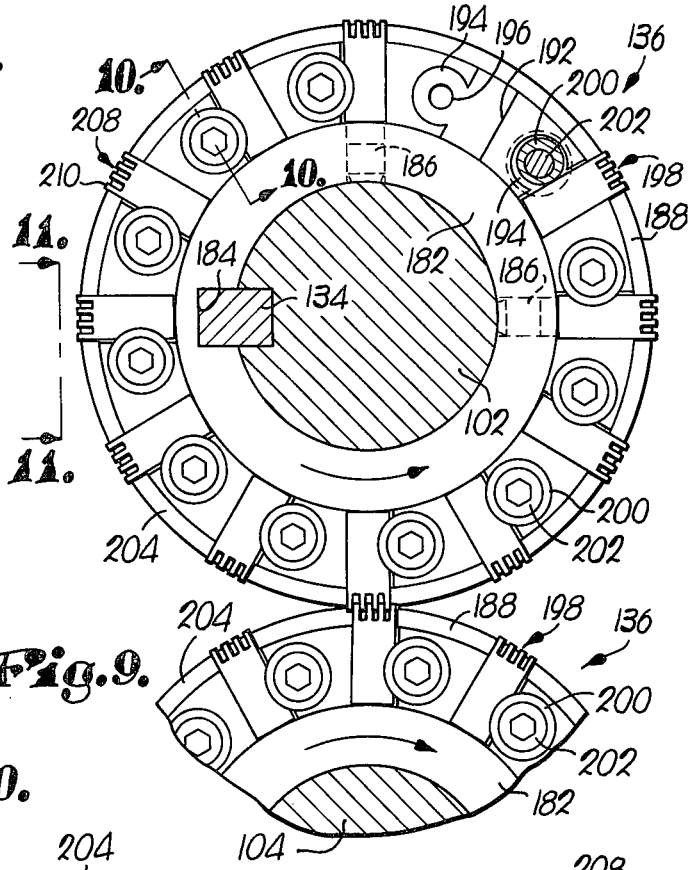
Fig.9.
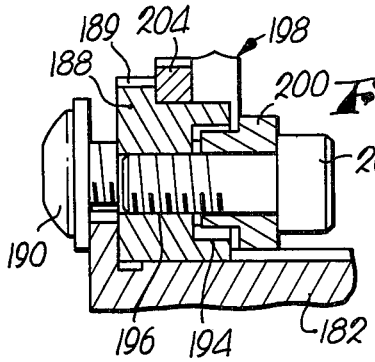
Fig.10.
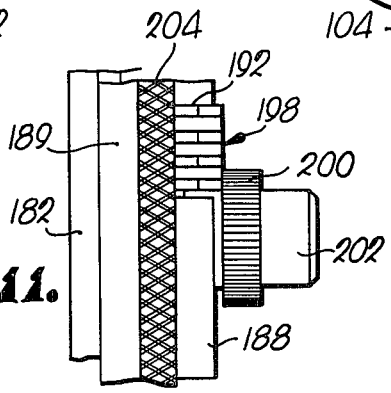
Fig.11.
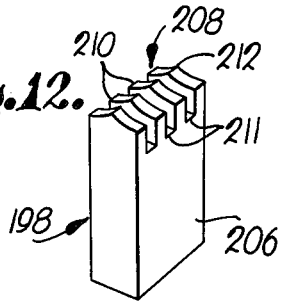
Fig.12.
Fig.17.
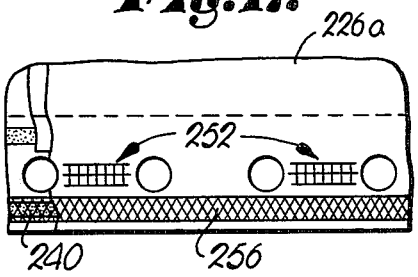
Fig.18.
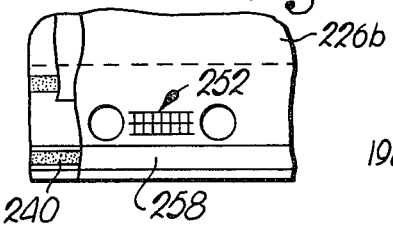
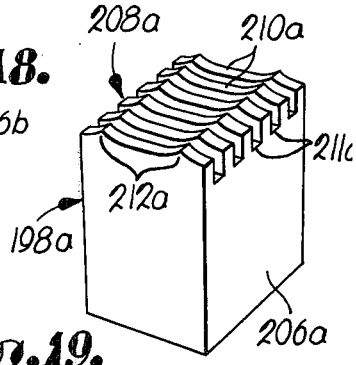
Fig.19.
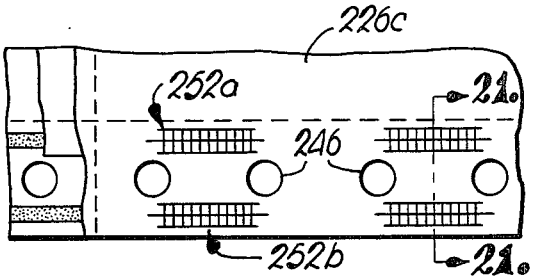
Fig.20.
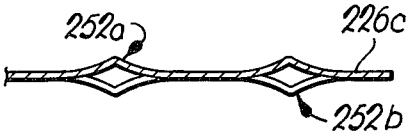
Fig.21.

MECHANISM FOR EFFECTING INTERLOCK OF MULTIPLE SHEET CONTINUOUS BUSINESS FORMS

This invention relates to an improved apparatus and method for providing a positive interlock between the respective plies of an elongated, multiple sheet web, such as those commonly used for producing business forms or computer print out paper. More particularly, it is concerned with a shear-cutting apparatus and method which serves to produce marginal, transversely oriented, shear-cut interlocking strips which are connected at the opposed ends thereof to the web, with adjacent strips being displaced in opposite directions relative to each other, so as to achieve the most desirable interlocking function. Particular features of the invention include the use of respective, cooperating pairs of multiple-blade web-shearing and displacing dies which cooperatively engage, support, shear-cut and deform a moving web to quickly and efficiently produce the desired interlocking strips with minimum web disturbance and/or skewing of respective web plies, even when the web is moving at very high or changing speeds. In addition, the blades of the cooperating dies are preferably pointed and configured for interfitting during the web-shearing and deforming sequence, to further facilitate production of the desired interlocking strips.

Multiple-ply business forms and the like are generally produced using web-fed equipment wherein a number of continuous sheets or plies of paper are overlaid and fed through a number of processing stations. In one such unit, the respective plies are fed in a glued condition into a so-called marrying station where further steps such as crash numbering is carried out. The married plies are then fed to a bindery station wherein they are locked together and press-ironed, followed by cross perforation of the web to define separable business forms or the like. The last station includes a zigzag folder wherein the continuous web is folded in a zigzag fashion.

A persistent problem in the production of such continuous web products stems from the tendency of the respective plies to longitudinally shift relative to one another, especially during folding operations. In this connection the relatively high web speeds achieved with modern-day production units often-times means that the glue applied to the web plies has not fully set prior to entrance of the web into the folding section. Thus, the individual plies of the web can become misaligned during zigzag folding, whereupon the glue between the plies will set and cause a permanent misalignment between the plies at the area of the transverse fold lines. This phenomenon is commonly referred to in the art as "tenting", and is particularly troublesome in the case of computer print out paper and the like which is adapted for use in automated equipment, because of the fact that tented webs can jam such equipment.

A number of suggestions have been made in the past to overcome the problems of tenting and web ply misalignment in general. For example, one proposal has been to "crimp" the moving web plies in order to effect at least a partial interlock between the same. Crimping in this art refers to formation of cut tails having a free end and which extend through the web. These tails are longitudinally aligned with the web and serve to prevent relative transverse shifting of the web plies. One type of prior crimping device is described in U.S. Pat. No. 2,935,002, which employs rotating penetrating knives which coact with a circumferentially grooved anvil roll. Crimping is generally not accompanied by gluing of the web sheets, and in fact is designed to allow a certain degree of relative longitudinal shifting between the sheets. Thus, this method overcomes the problem of tenting since no glue is present to permanently set the folded plies in a misaligned condition. On the other hand, crimping does not provide the most secure interconnection between the web sheets since the tails are longitudinally aligned with the web and not connected at both ends thereof to the web. Moreover, knife and anvil devices provide penetration through only one face of the web, and this unequal penetration can cause a lifting movement or "picking" of the web during cutting thereof, as well as skewing of the web.

A second type of web connection is referred to as "impacting", and this is normally done in conjunction with glue application. U.S. Pat. No. 3,727,908 describes one prior impacting unit which employs a pair of coacting, toothed wheels which produce a series of transversely extending, undulating, impacted areas along the length of a web where the latter is glued. Impaction generally does not involve an actual cutting or penetration of the web however, but instead relies upon a commingling of the fibers of the web plies to produce a holding action. While in some cases impaction can give an adequate bond between web plies, the impacting wheels must be carefully sized and mounted since the high forces between the wheels result in sufficient traction to actually serve as an important part of the web driving system. The high forces also cause significant deformation of the material within the web which further complicates the problem of providing exact sizing and mounting; in some cases, different diameter impacting wheels have to be used for webs of differing thickness, number of plies, and/or type of paper.

U.S. Pat. No. 3,107,929 describes a multiple-ply manifold assembly having a plurality of side-by-side cut strips having the opposed ends thereof connected to the web. Moreover, adjacent strips of this construction are displaced in opposite directions relative to the major plane of the web. However, these strips are aligned with the longitudinal axis of the web, and are arranged in separate, spaced, transversely extending series. Accordingly, maximum resistance to longitudinal ply shifting is not achieved.

It is therefore the most important object of the present invention to provide an improved apparatus and method for positively interlocking the respective plies of a moving, multiple ply web during fabrication thereof, so as to eliminate the problem of tenting and longitudinal web ply misalignment, and to overcome the deficiencies inherent in conventional crimping or impacting units heretofore provided for this purpose.

As a corollary to the foregoing, another object of the invention is to provide interlocking apparatus having respective, opposed, cooperating pairs of rotatable interlock dies mounted adjacent the opposite faces of a movable web and rotatable for cooperatively engaging, substantially equally supporting, shear-penetrating and deforming the web in order to create a series of transverse shear-cut interlocking strips in the web, with adjacent strips extending in opposite directions from the major plane of the latter; in particularly preferred forms, the respective rotatable dies include a plurality of elongated, spaced, side-by-side, web-shearing and displacing blades which are disposed transversely relative to the path of travel of the web, and are configured for at least partial interfitting during the web-shearing and deforming sequence, so as to form unitary shear-cut strips having the opposed ends thereof positively connected to the web.

Another aim of the invention is to provide interlocking apparatus of the type described which further includes web-ironing means for simultaneously press-ironing a moving web over the glue lines thereof and during formation of the interlocking strips so as to even out and enhance the effectiveness of the glue; in preferred forms, the web-ironing structure includes a pair of opposed ironing rings having the peripheries thereof knurled and which are mounted adjacent the multiple-blade dies for creating a continuous press line over the glued portion of the web and adjacent the shear-cut strips, in order to further increase the connection between the respective plies of the web.

In the drawings:

FIG. 1 is a perspective view of an elongated, marginally punched and perforated, zigzag folded web of the type used for computer print out paper or business forms;

FIG. 2 is a side elevational view of the web illustrated in FIG. 1 with the leading sections thereof unfolded to illustrate the problem of tenting;

FIG. 3 is an essentially schematic side elevational view of an in-line web fed unit for producing continuous business forms or the like;

FIG. 4 is a side elevational view of the preferred interlocking apparatus in accordance with the invention;

FIG. 5 is a front elevational view of the interlocking apparatus taken along 5—5 of FIG. 4;

FIG. 6 is a vertical sectional view taken along line 6—6 of FIG. 5 and illustrating certain of the details of construction of the interlocking apparatus;

FIG. 7 is a fragmentary sectional view taken along irregular line 7—7 of FIG. 4 and further illustrating the details of the interlocking mechanism;

FIG. 8 is a vertical sectional view taken along line 8—8 of FIG. 5, and illustrates details of the interlocking mechanism, with the operation of the shifting mechanism provided with the unit being depicted in phantom;

FIG. 9 is a fragmentary, enlarged sectional view showing the details of the web-shearing dies and the rotatable structure supporting the same;

FIG. 10 is a fragmentary sectional view taken along line 10—10 of FIG. 9 and illustrates the preferred clamping structure for removably mounting the web-shearing dies;

FIG. 11 is an elevational view taken along line 11—11 of FIG. 9 and illustrates the side-by-side orientation of the press-ironing rings and dies;

FIG. 12 is a perspective view of one type of web-shearing die used in the present invention, having only a single peak or tip in the blades thereof;

FIG. 13 is a fragmentary, enlarged view illustrating the interfitting of a pair of die blade tips during the web-cutting and displacing sequence;

FIG. 14 is a fragmentary plan view with parts broken away for clarity illustrating a multiple-ply web having adjacent, transversely oriented, oppositely displaced interlocking strips formed in the margin thereof;

FIG. 15 is an enlarged sectional view taken along line 15—15 of FIG. 14 further illustrating the preferred relative orientation of the interlocking strips;

FIG. 16 is a sectional view taken along line 16—16 of FIG. 15 and depicting in detail the oppositely directed displacement of adjacent interlocking strips;

FIG. 17 is a fragmentary plan view with parts broken away for clarity of a multiple-ply web having transverse interlocking strips in accordance with the invention, along with a continuous knurled or diamond-shaped pressed section adjacent the side margin thereof;

FIG. 18 is a view similar to FIG. 17 but illustrating a web having a generally planar, flattened, press-ironed strip;

FIG. 19 is a perspective view of an alternate type of web-shearing die usable in the apparatus of the invention, which includes a pair of spaced web-penetrating points in the respective blades thereof;

FIG. 20 is a fragmentary plan view with parts broken away for clarity illustrating the configuration of the interlocking strips produced through the use of double pointed plies of the type depicted in FIG. 19; and FIG. 21 is an enlarged sectional view taken along line 21—21 of FIG. 20 which illustrates the configuration of the depicted interlocking strips.

Turning now to the drawings, FIG. 1 illustrates an elongated, continuous web 30 which in this case is composed of three face-to-face, interconnected plies 32, 34 and 36. Web 30 is zigzag folded in the conventional manner for ease of storage and handling. As indicated above, it is common to interconnect the plies 32, 34 and 36 by means of side marginal glue lines; but unless some means is provided for preventing relative longitudinal shifting between the plies during fabrication of the web, the problem of "tenting" can occur. Tenting most often stems from relative shifting between the web plies during the zigzag folding operation, when the marginal glue lines are not fully set. After such folding and consequent misalignment between the web plies however, the glue lines do fully set, thereby permanently bonding the plies in their shifted relation. As a consequence of this phenomenon, the transverse fold lines (which are generally perforated) are "tented" as at 38 (see FIG. 2). This permanent tenting of the web 30 can cause severe problems, especially if the web is used in automated equipment such as a computer print out unit. In such cases the tented areas of the web can cause jamming of the printer, which as a consequence means that the unit must be shut down and the web removed. As can be readily seen, this is an extremely objectionable result, since valuable computer time may be lost simply because a tented web is used in the printer.

Although forming no specific part of the present invention, it is to be understood that the interlocking apparatus hereinafter described in detail is especially designed for use in an elongated, in-line, multiple station web fabricating assembly 40 of the type schematically illustrated in FIG. 3. In the form shown, the assembly 40 includes four tandem-oriented paper stations 42, 44, 46 and 48 which are each adapted to hold a continuous roll of paper and include gluing heads 52. Marrying station 50 is mounted ahead of the paper stations 42–48, and includes lineal perforation section 54 for providing side marginal, longitudinally extending perforation lines along the length of the multiple-ply web. A bindery station 56 receives the web from the station 50 and includes an interlock-ironing assembly 58, in conjunction with a cross perforation section 60. Finally, a conventional zigzag folder 62 is provided at the output end of the assembly 40, and includes a receiving tray 64.

The preferred interlock-ironing assembly 58 broadly includes a supporting and frame structure 66 allowing mounting of the assembly within the in-line apparatus described, die-supporting mechanism 68, drive means 70 for rotating the web-engaging dies in timed relationship, and selectively actuatable linkage and gear structure 72 allowing selective disposition of the interlock dies and related structure between operative and nonoperative positions in a manner to assure smooth operation of the mating interlock dies.

In more detail, supporting and frame structure 66 includes a pair of spaced, upstanding, generally L-shaped main sidewalls 74 and 76. In addition, a pair of corresponding, generally rectangular shaft-supporting walls 78 and 80 are respectively disposed within the recess defined by the main sidewalls 74 and 76, and are removably secured thereto by means of clamping bolts 82 and 84.

Drive means 70 includes two elongated, transversely extending shafts 88 and 90 which extend through the main sidewalls 74 and 76, and have respective drive pulleys 94 and 96 coupled thereto exteriorily of wall 74 (see FIG. 4). A drive belt 100 is trained around the pulleys 94, 96 and 98 and forms therewith a drive train. In the usual fashion, one of the shafts is powered for rotating belt 100 and the drive train.

Die-supporting mechanism 68 includes a pair of elongated, transversely extending, die-supporting shafts 102 and 104 which are disposed in spaced, generally parallel relationship. As best seen in FIGS. 5 and 7, the respective shafts 102 and 104 include elongated, axially extending mounting sections 106 and 108 on the left hand ends thereof as viewed in FIG. 5. The sections 106 and 108 extend through appropriate apertures in the sidewall 78. In addition, somewhat shorter, axially extending mounting shaft sections 114 and 116 are provided on the opposite ends of the shafts 102 and 104, but as best shown in FIG. 5, these sections do not extend beyond the adjacent sidewall 80.

Linkage and gear structure 72 includes gears 110 and 112 which are respectively mounted adjacent the outermost ends of the sections 106 and 108. Moreover, the shafts 102 and 104 are respectively supported between the sidewalls 78 and 80 by means of four generally rectangular linkage plates 118, 120, 122 and 124 located in pairs 118, 120 and 122, 124 proximal to the sidewalls 78 and 80. As best seen in FIG. 5, separate bearing structures 126, 128, 130 and 132 are provided with the respective linkage plates for rotatably supporting the shafts 102 and 104.

Each shaft 102 and 104 is also provided with an elongated, axially extending, radially protruding peripheral key 134. These keys 134 are adapted to support and permit lateral adjustment of a pair of separate, annular die structures 136 mounted on each of the shafts 102 and 104. The details of these die structures 136 will be described more fully hereinafter.

Structure 72 also includes a pair of elongated, transversely extending drive shafts 138 and 140. Each of these shafts extends through the opposed sidewalls 78 and 80, and the ends thereof proximal the gears 110 and 112 include respective gears 142 and 144 which drivingly mesh with the adjacent gear 110 or 112 (see FIG. 4). Each of the shafts 138 and 140 is supported by means of respective bearings 146 and 148 mounted in sidewall 78, as well as bearings 150 and 152 provided with sidewall 80. Referring specifically to FIG. 7, it will be seen that sidewall 78 is also provided with a pair of vertically spaced, inwardly extending, rotatable, annular bushings 154 and 156 which receive the ends of the shafts 138 and 140. In addition, a pair of meshing alignment gears 158 and 160 are mounted onto the respective bushings 154 and 156 and are rotatable therewith. Finally, the gears 158 and 160 are coupled to the adjacent corresponding linkage plate 118 and 120 so that the plates, gears and bushing can rotate together. Sidewall 80 is similarly provided with inwardly extending rotatable annular bushings 162 and 164 which are respectively coupled to alignment gears 166 and 168, and with the linkage plates 122 and 124. These mounting assemblies for the shafts 138 and 140 allow for selective and simultaneous movement of the interlock dies into and out of their operative positions as will be explained.

Finally, it will also be seen that the outermost end of shaft 140 is provided with an axially extending, belt-receiving pulley 170. Drive belt 100 is trained around the pulley 170 for powered rotation of the latter; and as can be readily appreciated from the foregoing discussion, such rotation effects corresponding rotation of the shafts 138 and 140, and 102 and 104, through the medium of the meshed gears 142, 144, and 142, 110 and 144, 112.

Linkage and gear mechanism 72 also includes an elongated, axially rotatable shaft 172 which extends between the sidewalls 78 and 80 and is rotationally coupled to the same. A pair of spaced, motion-transmitting blocks 174 are in turn connected between the shaft 172 and respective, depending linkage elements 176. The latter are operatively connected to the upper linkage plates 118 and 130. Finally, the mechanism 72 also includes an operating handle 178 which is secured to the shaft 172 adjacent sidewall 78, along with an eccentrically mounted, rotatable, adjustable stop 180. The latter can be adjusted for correspondingly adjusting the limits of the overall mechanism 72.

Each die structure 136 includes an annular hub 182 which is provided with an axially extending keyway 184 complemental with the keys 134 on the shafts 102 and 104. In this manner the respective hubs are axially shiftable on the shafts 102 and 104 and are selectively secured in place thereon by means of set screws 186 (see FIG. 9). An annular mounting ring 188 having a radially outwardly extending retainer portion 189 is positioned on hub 182 and is secured thereto by means of a series of clamping bolts 190. Ring 188 is provided with a plurality of radially extending, die-supporting slots 192 which are arranged in circumferentially spaced relationship around the ring. In addition, a generally annular recess 194 and threaded bore 196 are provided adjacent each slot 192.

Each slot 192 is adapted to receive a block-type interlock die generally referred to by the numeral 198. In order to clamp the respective dies 198 in place, a plurality of annular clamping members 200 and cooperable clamping bolts 202 are provided. Referring specifically to FIG. 10, it will be seen that the clamping member 200 is adapted to abut the outermost surface of the die 198, with the bolt 202 extending into the corresponding bore 196 to securely clamp the die in place. In addition, in preferred forms an annular press-ironing ring 204 is interposed between the faces of the dies 198 remote from the members 200, and the retainer portion 189 of the ring 188. As can be appreciated, the ring 204 is clamped in place by virtue of this construction, so as to rotate in unison with the dies 198. In the form shown in FIG. 11, press ring 204 has a knurled or diamond-shaped surface pattern, but in other instances different surface configurations could be employed. Furthermore, it will be appreciated that cooperating pairs of rings are provided with the respective die structures 136 for engaging the opposite faces of a web passing therebetween.

Referring specifically to FIG. 12, interlock die 198 is shown in perspective. Die 198 includes a generally rectangular, upstanding block section 206 which is milled at the upper end thereof to provide a blade set 208. The latter includes a series of elongated, spaced, side-by-side lands or blades 210 separated by slots 211, with each of the blades 210 having a single web-penetrating tip or peak 212, so that the blades are generally pointed. In alternate forms, a die 198*a* (see FIG. 19) is provided which includes a rectangular block 206*a* and an upstanding blade set 208*a*. As before, the set 208*a* includes a plurality of spaced blades 210*a* having slots 211*a* therebetween. In this case however, a pair of spaced peaks or tips 212*a* are provided with each blade 210*a*. It will be appreciated that additional alternate forms of dies can also be used to good effect, such as dies having smoothly rounded blades.

As described, the dies 198 or 198*a* are mounted within the slots 192 provided in the rings 188. In this regard it is important to note that the blades 210 or 210*a* are disposed axially with respect to the die mounting structure, or in other words, transversely relative to the side margins and path of travel of a web passing through assembly 58. This transverse orientation of the die blades in turn produces transverse interlocking strips in the web, and this is an important preferred feature of the invention.

The operation of the mechanism 58 will now be described in detail. First of all, during initial start up, linkage handle 178 is manipulated to open the opposed sets of die structures 136, in order to allow threading of a multiple-ply web therethrough. Referring to FIG. 8, it will be seen that rotation of handle 178 operates through the blocks 174 and linkage elements 176 to elevate and rotate the corresponding plates 118 and 122 about the axis defined by the drive shaft 138. This action in turn causes an equal downward shifting of the lower linkage plates 120 and 124 through the intermeshing and rotation of the gears 158, 160 and 166, 168, which are coupled to the corresponding linkage plates. As shown in FIG. 8, rotation of the plates 120 and 124 occurs relative to the lower shaft 140.

In any event, the next step involves lateral shifting as necessary of the four die structures 136 so that two opposed pairs or sets of die structures 214 and 216 are respectively presented adjacent the side marginal edges of the multiple-ply web 30. As best shown in FIG. 5, the individual dies of the sets 214 and 216 are respectively above and below the web 30 and cooperatively present a pair of marginal operating nip areas for receiving the web 30. After the die structures 136 are properly located relative to the web 30, handle 178 can be rotated to return the shafts 102, 104 to their original, operating position. This merely involves a reversal of the opening operation, with the upper and lower linkage plates being shifted equally toward each other until marginal nips are presented by the adjacent die structure pairs 214 and 216.

Assembly 58 is now ready for interlocking operations when the overall in-line assembly 40 is started up, along with drive means 70. In particular, movement of the drive means 70 causes the belt 100 to drivingly engage and rotate the pulley 170, which in turn causes rotation of the shaft 140 in a clockwise direction as viewed in FIG. 4; this in turn causes rotation of the remaining follower gears 142, 110 and 112 with the result that the shafts 102 and 104 are respectively rotated in opposite directions as exemplified by the arrows 218 and 220 of FIG. 4. Counter rotation of the shafts 102 and 104 in turn causes the respective opposed die structures 136 mounted thereon to likewise rotate oppositely, with the effect that the side margins of the multiple-ply web 30 are acted upon by the dies 198 as the web is advanced through assembly 58.

It will also be recognized that the gears 140, 142, 110 and 112 in effect form a single train of gears by virtue of the intermeshing thereof. This preferred construction assures that the respective mated dies carried on the opposed structures 136 will smoothly interfit during rotation of the shafts 102 and 104, without any interference between the die blades. Moreover, this single gear train, along with shaft-supporting linkage arms which move equally toward and away from each other as described, ensures that the respective dies will be properly oriented for smooth intermeshing at all times, even at the outset of web interlocking operations. As can be appreciated, if the lower linkage arms were stationary and the upper arms shiftable relative thereto, the arc of travel of the die blades on the upper shaft could be such as to prevent smooth initial mating of the upper and lower dies; however, provision of structure for equally shifting the linkage arms overcomes this potential problem.

As discussed hereinabove, a prime feature of the present invention stems from the manner in which the web 30 is shear-cut and displaced by the dies 198. In general, respective, cooperating pairs of mated, interlocking, shear-cutting dies 198 are provided with the adjacent, opposed structures 136. These pairs of dies serve to intermittently engage and cooperatively shear-penetrate, deform and displace sections of the moving web 30, in order to produce a series of interlocking strips in the web. In preferred forms the die blades are identical so that during interfitting thereof the opposed dies penetrate the web to an equal extent. This in turn ensures that the web is substantially equally supported by the cooperating dies, and that the latter exert a substantially equal driving force on the web. This is to be contrasted with conventional crimping units which provide what amounts to an anvil roll for supporting a moving web, along with cutting knives which extend through the web. This type of unit of necessity gives unequal penetration of the web (i.e., from one side only), and is prone to skew the web plies because of this operational characteristic. It will also be appreciated that the transverse orientation of the die blades, along with rotation thereof about an axis generally parallel to the longitudinal axes of the blades, produces interlocking strips that are transverse relative to web length and travel. As a consequence, the strips are capable of securely locking the web plies against relative longitudinal shifting, so that the "tenting" problem is effectively overcome.

Attention is now directed to FIG. 13. In this case a pair of die blades 210*b* and 210*c* are illustrated during a web-shearing and displacing sequence. It is to be especially noted in this respect that the web penetrating tips 212*b* and 212*c* of the blades cooperatively interfit during this operation, with the tipe being received within cooperating slots defined by the blades of the opposed die. It is also apparent that the web 30 is substantially equally supported by the blades 210*b* and 210*c*, so that unequal distribution of shearing and driving forces is avoided. This results in an upstanding, somewhat pointed strip 222 and an adjacent, downwardly extending, essentially identical strip 224. These strips are fully connected to the web 30 at the respective ends thereof, and moreover the strips remain intact throughout their entire length, so that formation of "tails" is avoided.

This type of web-shearing and displacing action is repeated by the cooperating blade sets of the individual mated pairs of dies during rotation of the structures 136, so as to form series of alternating, oppositely directed interlocking strips. In each case the above-described action is repeated so that all of the interlocking strips are essentially identical.

FIGS. 15 and 16 illustrate a multiple-ply web 226 as it would appear after fabrication in apparatus 40, using therein assembly 58 having single tipped blades. In this case the web 226 includes three paper plies 228, 230 and 232, along with interleafed carbon sheets 234 and 236. Two elongated, substantially coincident glue lines 238, 240 are respectively applied to the plies 232 and 230, in order to interconnect the major paper plies. Similarly, two inwardly spaced glue lines 242, 244 are employed for connecting the carbon sheets 234, 236 to the underlying plies. Conventional, longitudinally spaced, pin-receiving apertures 246 are provided along the side margin of the web 226, along with a longitudinally extending perforation line 248 and a series (only one of which is shown) of spaced, cross-perforation lines 250.

A series of interlocking strips 252 is provided between alternating pairs of the apertures 246. Each series of strips includes a plurality of transversely extending, displaced, individual strips 254. Each of the strips 254 is connected at the opposed ends thereof to the web 246, and alternate strips 254 are displaced in opposite directions from each other and from the major plane defined by the web 226 (see FIG. 15). As best shown in FIG. 16, the respective strips 254 are of unitary construction and are not slit or cut at the central area thereof.

Provision of the strips 254 serves to effectively interlock the web 226 and prevent tenting or relative shifting between the individual plies or sheets thereof during zigzag folding. The transverse orientation of the strips, along with their unitary construction and alternate displacement, are believed chiefly responsible for this result. Furthermore, the full and complete web shearing action afforded through the use of the instant invention results in interlocking strips 254 which are in abutting relationship to each other and the web itself.

Referring now to FIG. 17, a web 226*a* is illustrated which in most respects is identical with the web 226. In this instance however, an elongated, continuous, longitudinally extending, marginal press-ironed pattern 256 is provided, along with the series 252 of interlocking strips. The pattern 256 is located over the glue line 240. This pattern 256 is provided through the use of a press ring 204 of the type best illustrated in FIG. 11, which has a diamond-shaped surface configuration.

FIG. 18 illustrates a web 226*b* which is very similar to the web 226*a*, but includes a smooth press-iron pattern 258. In this case an ironing ring (not shown) having a smooth, outer, web-engaging surface would be employed with each cooperating pair of die structures 136.

Finally, attention is directed to the web 226*c* of FIGS. 20 and 21. In this instance double peaked dies 198*a* have been employed to provide two side-by-side series 252*a* and 252*b* of interlocking strips between alternating pairs of pin-receiving openings. These series of strips are identical with those described in connection with FIGS. 14–16, and therefore need not be described in detail again. However, it will be noted that in this case the strips are shear-cut into the web 226*c* over the glue lines, whereas in the first-described embodiment slits were provided between the pin-receiving apertures 246.

Having thus described the invention, what is claimed as new and desired to be secured by Letters Patent is:

1. Apparatus for interlocking the plies of an elongated, multiple-ply web moving along a path of travel for preventing significant relative longitudinal shifting between the plies, said apparatus comprising:

first and second rotatable, die-supporting structures respectively located adjacent the opposed faces of said web and proximal to a common side margin of the latter;

a plurality of circumferentially spaced interlock dies mounted on the peripheries of each of said first and second supporting structures to present respective, cooperating pairs of dies, each of said dies including a blade set having a plurality of spaced, side-by-side, web-shearing and displacing blades each provided with an elongated outer end extending between opposed narrow side margins thereof, the elongated direction of said outer ends of the blades being substantially transverse relative to the direction of travel of said web, each of said blades having a web penetrating outer web shearing and displacement section which projects above said side margins of the respective blade;

means for rotating said structures in timed relationship for causing the blades of said respective pairs of dies to intermittently engage, cooperatively shear-penetrate and deform the moving web, with the blades of said respective die pairs interfitting during said web penetration and deformation, the blades of each cooperating die set being of a height to provide substantially equal support for the web with only said outer shearing and displacement sections thereof penetrating the web in order to create a series of transversely extending, adjacent, side-by-side, multiple ply, shear cut strips which are connected at the opposed ends thereof to the web, with adjacent strips being displaced substantially equal distances in opposite directions from the major plane of the web.

2. Apparatus as set forth in claim 1 wherein said die-supporting structures include first and second annular hubs, and elongated, rotatable first and second shafts respectively supporting the corresponding hubs.

3. Apparatus as set forth in claim 1 including linkage structure for allowing selective movement of said die-supporting structures between an operative position proximal to said web, and an open position with the die-supporting structures spaced from the web.

4. Apparatus as set forth in claim 1 wherein said blades on said dies each include at least one pointed tip defining said shearing and displacement section.

5. Apparatus as set forth in claim 1 wherein said blades on said dies each include a plurality of pointed tips defining said shearing and displacement section.

6. Apparatus as set forth in claim 1 wherein each of said dies is a unitary member and includes a block portion, with said blades extending from the block portion.

7. Apparatus as set forth in claim 1 including web-ironing means for press-ironing said moving web along the length thereof.

8. Apparatus as set forth in claim 7 wherein said web-ironing means comprises first and second ironing wheels respectively mounted on said die-supporting structures adjacent said dies.

9. Apparatus as set forth in claim 8 wherein said first and second ironing wheels are knurled.

10. Apparatus for interlocking the plies of an elongated web having spaced, parallel side marginal edges and which is moving longitudinally along a path of travel, for preventing significant relative shifting between the plies, said apparatus comprising:

a pair of axially rotatable shafts respectively disposed in spaced relationship to the opposed faces of said web and substantially transversely relative to said path of travel;

a pair of axially spaced, die-supporting hub members respectively mounted on each of said shafts adjacent the side marginal edges of said web, with the hubs on each shaft being substantially aligned with the hubs on the opposed shaft;

a plurality of interlock dies for each hub respectively, each of said dies including a blade set having a plurality of spaced, side-by-side, web-shearing and displacing blades each provided with an elongated outer end extending between opposed narrow side margins thereof, each of said blades having a web penetrating outer tip which projects above said side margins of the respective blade;

means mounting said dies in circumferentially spaced relationship on the corresponding hubs, with said blades extending outwardly therefrom and oriented with the elongated direction of said outer ends of the blades extending generally transversely relative to said path of travel and side marginal edges, for presenting two cooperating sets of opposed dies respectively adjacent the side margins of said web and with the latter located between the dies of each set, each of said sets including a number of respective, cooperating pairs of dies; and means for rotating said shafts in timed relationship for causing the blades of said respective pairs of dies in each set to intermittently engage, cooperatively shear-penetrate and deform the moving web at points adjacent the side margins of the latter, with the blade tips of said respective die pairs interfitting during said web penetration and deformation, and with the tips of the blade sets of each cooperating die in each respective pair thereof overlapping to an equal extent to provide substantially equal support for the web relative to the other cooperating die, only the tips of opposed blades penetrating the web in order to create two series of marginal, transversely extending, side-by-side, multiple-ply, shear-cut strips which are respectively connected at opposed ends thereof to the web, with adjacent strips in each series being displaced substantially equally in opposite directions relative to the major plane of the web.

11. Apparatus for interlocking the plies of a multiple-ply web moving along a path of travel, said apparatus comprising:

at least one pair of opposed interlock dies respectively disposed adjacent the opposite faces of said web, each of said dies including a blade set having a plurality of spaced, side-by-side, web-shearing and displacing blades each having an elongated outer end extending between narrow side margins;

means for supporting said dies with the blades thereof with the elongated direction generally transversely oriented relative to the direction of travel of said web; and each of said blades having a paper penetrating outer web shearing and displacement section which projects above said side margins of the respective blade;

means for shifting at least one of the dies for causing the blades of said pair of dies to engage, shear-penetrate and deform said web with at least partial interfitting of the blades of the dies during said web penetration and deformation, the blades of said opposed die sets being of a height to provide substantially equal support for the web with only said outer shearing and displacement sections thereof penetrating the web in order to create a series of shear-cut interlocking strips which are connected at opposed ends to the web, with adjacent strips extending substantially an equal distance in opposite directions from the major plane of the web.

12. Apparatus as set forth in claim 11 wherein at least certain of said blades include an outermost, generally pointed, web-penetrating tip defining said shearing and displacement section.

13. Apparatus as set forth in claim 12 wherein at least certain of said blades include a plurality of spaced, generally pointed, web-penetrating tips defining said shearing and displacement section.

14. Apparatus as set forth in claim 11 wherein said die supporting and shifting means includes an annular, rotatable hub for each die respectively, and means mounting the respective dies on the corresponding hubs.

15. Apparatus as set forth in claim 14 including a plurality of circumferentially spaced interlock dies mounted on each hub.

16. Apparatus as set forth in claim 11 including web-ironing means for press-ironing said moving web.

17. A method of interlocking the plies of an elongated multiple-ply web moving along a path of travel, comprising the steps of:

providing at least one pair of interlock dies including a blade set having a plurality of spaced, side-by-side web-shearing and displacing blades each provided with an elongated outer end extending between opposed narrow side margins thereof;

supporting said dies in spaced relationship with said moving web therebetween and with the elongated direction of the outer ends of said blades being oriented generally transversely relative to the direction of travel of the web, each of said blades having a web penetrating outer web shearing and displacement section which projects above said side margins of the respective blade;

shifting said dies along respective, arcuate paths, and causing the blade sets thereof to cooperatively engage, shear-penetrate and deform said web, and to at least partially interfit during said web penetration and deformation, the blades of each cooperating die being of a height to provide substantially equal support for the web with only the shearing and displacement sections penetrating the web in order to create a series of interlocking, transversely extending, adjacent strips in the web, with adjacent strips being displaced substantially equally in opposite directions from the major plane of the web.

18. The method as set forth in claim 17 including the step of locating said dies adjacent a common marginal edge of said web.

19. The method of claim 17 including the step of press-ironing said web by passing the same between a pair of opposed, rotating press elements.

20. The method of claim 17 wherein said blades include a single, generally pointed, web-penetrating tip defining said shearing and displacement section.

21. The method of claim 20 wherein said blades each include a pair of spaced, generally pointed, web-penetrating tips defining said shearing and displacement section and including the step of forming respective side-by-side series of said deformations in the web.

* * * * *